US007691016B2

(12) United States Patent
Ashino

(10) Patent No.: US 7,691,016 B2
(45) Date of Patent: Apr. 6, 2010

(54) RACKET

(75) Inventor: Takeshi Ashino, Hyogo (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 12/213,659

(22) Filed: Jun. 23, 2008

(65) Prior Publication Data

US 2009/0017948 A1 Jan. 15, 2009

(30) Foreign Application Priority Data

Jul. 10, 2007 (JP) ..... 2007-180656

(51) Int. Cl.
*A63B 49/00* (2006.01)

(52) U.S. Cl. ..... 473/539; 473/537; 473/521; 473/522

(58) Field of Classification Search ..... 473/520–522, 473/537, 539
See application file for complete search history.

(56) References Cited

U.S. PATENT DOCUMENTS 5,762,570 A * 6/1998 Shaw ..... 473/522
5,993,337 A * 11/1999 Janes et al. ..... 473/539
6,527,656 B1 * 3/2003 Cheng et al. ..... 473/540
2009/0017948 A1 * 1/2009 Ashino ..... 473/522

FOREIGN PATENT DOCUMENTS

JP 2534963 B2 6/1996
JP 2004-105558 A 4/2004

* cited by examiner

*Primary Examiner*—Raleigh W. Chiu
(74) *Attorney, Agent, or Firm*—Birch, Stewart, Kolasch & Birch, LLP

(57) ABSTRACT

A racket including a string-stretching part for forming a ball-hitting face by tensionally mounting strings in string holes, formed through the string-stretching part, in which grommets are mounted respectively. As the grommets, a double-tubular grommet is mounted in at least one of the string holes. The double-tubular grommet is formed as an integrally molded article, including an inner tubular portion having a string insertion hole through which the string is inserted with the string in contact with the string insertion hole and pulled from an inward-end open portion thereof or an outward-end open portion thereof; an outer tubular portion fitted in the string hole formed through the string-stretching part with the outer tubular portion spaced at a certain interval from the inner tubular portion; and a base portion integrally connected with an outward-side end of the inner tubular portion and that of the outer tubular portion and disposed on a peripheral surface of the string-stretching part.

14 Claims, 9 Drawing Sheets

Prior Art

Prior Art

Prior Art

RACKET

This nonprovisional application claims priority under 35 U.S.C. §119(a) on Patent Application No(s). 2007-180656 filed in Japan on Jul. 10, 2007, the entire contents of which are hereby incorporated by reference.

BACKGROUND OF THE INVENTION

1. Field of the Invention

The present invention relates to a racket for tennis and the like and more particularly to a racket having an improved grommet mounted in string holes formed through a string-stretching part to increase the sweet area of a ball-hitting face of a racket frame and improve the vibration-damping performance thereof.

2. Description of the Related Art

As shown in FIG. 8, in a conventional racket frame, string holes 2 are formed in penetration through a string-mounting part 1 constituted of a circular arc-shaped frame surrounding the ball-hitting face, with the string holes 2 disposed vertically to tangents to the string-stretching part 1. In this method, it is easy to use a drill in forming the string holes 2 in the direction from the inner peripheral side 1*a* of the racket frame 1 to the peripheral side 1*b* thereof. Further this method allows a required length of a string S to be short.

The strings S to be tensionally mounted on the racket frame are composed of longitudinal strings tensionally mounted through the string-stretching part 1 with the longitudinal strings disposed in parallel or approximately parallel with the longitudinal axis of the racket frame drawn from the top of the ball-hitting face to the center of the grip and transverse strings tensionally mounted through the string-stretching part 1 with the transverse strings disposed orthogonally to the longitudinal strings.

Except the longitudinal string passing through the top of the racket frame 1 and the transverse string passing through both sides of the head part having the longest width, the string-stretched direction is not coincident with the direction in which the string holes 2 are formed in penetration through the racket frame 1. Because the string S is bent in contact with the inner opening 2*a* of the string hole 2 disposed on the inner peripheral surface of the racket frame 1, the effective length of the string S is equal to the length between the opposed inner peripheral edges of the frame 1 surrounding the ball-hitting face.

The sweet area of the racket frame can be increased by increasing the effective length of the string. Therefore proposals for increasing the effective length of the string have been hitherto made.

For example, as shown in FIG. 9, in the construction disclosed in U.S. Pat. No. 2,534,963 (patent document 1), the inner diameter of the string insertion hole 4*b* inside the tubular portion 4*a* of the grommet member 4 to be mounted on the racket frame 3 is set larger at the inward open portion 4*c* than at the outward open portion 4*d* to allow the movability of the string S to be large inside the racket frame 3.

As shown in FIGS. 10A and 10B, in the construction disclosed in Japanese Patent Application Laid-Open No. 2004-105558 (patent document 2), the string protection member 5 mounted on the racket frame is constructed of the soft grommet members 6 inserted into the string holes of the racket frame and the belt-shaped member 7 layered on the periphery of the soft grommet member 6. The belt-shaped member 7 has the long and narrow slits 8 communicating with the insertion holes 6*a* of the soft grommet member 6 respectively and crossing the insertion holes 6*a* respectively in the ball-hitting direction. In this construction, owing to a stress applied to the string S when a ball is hit, the string S slides on the slit 8 in the ball-hitting direction.

In the grommet member 4 of the patent document 1 and the string protection member 5 of the patent document 2, because the deformation support of the string S moves from the inward side of the racket frame to the outward side thereof, it is conceivable that the effective length of the string increases and thus the sweet area increases.

But it is conceivable that in the grommet member 4 of the patent document 1, the range of contact between the string S and the grommet member 4 is short, and the vibration of the string S is insufficiently damped. Thus a player has an unpleasant feeling when the player hits a ball.

In the string protection member 5 of the patent document 2, because there is little contact between the string S and the grommet member 6, it is difficult to damp the vibration of the string S. Thus the player feels vibration unpleasantly when the player hits the ball. Because the string S slides on the slit 8 when the player hits the ball, the string S has a low degree of durability owing to the sliding contact between the string S and the slit 8. Further the position of the string S changes each time the player hits the ball. Thus the speed of the ball and the player's feeling vary each time the player hits the ball. Further because the grommet member 6 and the belt-shaped member 7 are made of different materials, the string protection member 5 is assembled at a low operability and liable to be defectively mounted on the racket frame.

Patent document 1: U.S. Pat. No. 2,534,963

Patent document 2: Japanese Patent Application Laid-Open No. 2004-105558

SUMMARY OF THE INVENTION

The present invention has been made to solve the above-described problem. Therefore it is an object of the present invention to provide a racket in which a grommet and string holes where the grommet is mounted are improved to increase the effective length of a string and a sweet area of a racket frame so that the racket frame has improved repulsion for a ball. It is another object of the present invention to provide a racket in which the vibration of the string and that of the racket frame are damped so that a player can obtain a pleasant feeling when the player hits the ball.

To achieve the object, the present invention provides a racket including a string-stretching part for forming a ball-hitting face by tensionally mounting strings in string holes, formed through the string-stretching part, in which grommets are mounted respectively.

As the grommets, a double-tubular grommet is mounted in at least one of the string holes.

The double-tubular grommet is formed as an integrally molded article, including an inner tubular portion having a string insertion hole through which the string is inserted with the string in contact with the string insertion hole and pulled from an inward-end open portion thereof or an outward-end open portion thereof; an outer tubular portion fitted in the string hole formed through the string-stretching part with the outer tubular portion spaced at a certain interval from the inner tubular portion; and a base portion integrally connected with an outward-side end of the inner tubular portion and that of the outer tubular portion and disposed on a peripheral surface of the string-stretching part.

The racket has the string-stretching part constructed of the racket frame (hereinafter often referred to as merely frame) made of a fiber reinforced resin and a grip part to be gripped by a player. Longitudinal strings and transverse strings are respectively inserted through a large number of string holes formed through the string-stretching part and tensionally mounted therein respectively.

The double-tubular grommet is mounted in at least one string hole formed through the string-stretching part. The inner tubular portion, the outer tubular portion, and the base portion of the double-tubular grommet are formed by integrally molding a material consisting of rubber or resin having vibration-damping performance. The base portion is disposed in direct or indirect contact with the peripheral surface of the string-stretching part.

The double-tubular portion of the double-tubular grommet has the inner tubular portion projected inward from the base portion and having the insertion hole through which the string is inserted with the string in contact with the insertion hole. The double-tubular portion further has the outer tubular portion projected inward from the base portion with the outer tubular portion disposed around the peripheral surface of the inner tubular portion at a certain gap from the inner tubular portion.

An inward-side tip of the inner tubular portion through which the string is inserted is disposed at or beyond an inward open portion of the string hole.

Owing to the provision of the double-tubular grommet having the inner tubular portion and the outer tubular portion spaced at a certain interval therefrom, it is possible to prevent the string inserted through the inner tubular portion from contacting the outer tubular portion and the frame at the inward open portion of the string hole and increase the movable length of the string and thereby increase the sweet area. Further the inner tubular portion contacts the string, thus damping the vibration of the string. The outer tubular portion contacts the frame constructing the string-stretching part, thus damping the vibration of the frame.

This construction is capable of increasing the sweet area and improving the repulsion of the racket frame for the ball and effectively damping unpleasant vibration to be transmitted to the player, thus providing the player with a favorable feeling when the player hits the ball.

Because the base portion, the inward tubular portion, and the outward tubular portion are integrally formed, it is possible to assemble the double-tubular grommet with a high operability and provide the frame with a high durability.

It is preferable that the base portion of the double-tubular grommet is integrally connected with the base portion of the adjacent double-tubular grommet or the base portion of an adjacent grommet having only one tubular portion so that the integrally formed double-tubular grommet is belt-shaped.

But when a very large number of grommets is integrally connected with one another, the integrally formed double-tubular grommet is very long, which deteriorates the operability in assembling a double grommet member. Therefore the number of grommets to be integrally connected with one another is set to not more than 30, favorably not more than 20, more favorably not more than 10, and most favorably not more than five.

It is preferable that a pair of guide ribs is projectingly formed on an outer surface of the belt-shaped integrally formed double-tubular grommet with the guide ribs being spanned between the string inserted through the string insertion hole of the inner tubular portion of the double-tubular grommet and/or the string inserted through the string insertion hole of the grommet having the one tubular portion.

As described above, it is preferable that the inward-side tip of the inner tubular portion of the double-tubular grommet is disposed at the inward open portion of the string hole or projected into the ball-hitting face beyond the inward open portion. The inward-side tip of the outer tubular portion of the double-tubular grommet may be also disposed at the inward open portion of the string hole or may be projected into the ball-hitting face beyond the inward open portion.

By disposing the inward-side tip of the inner tubular portion of the double-tubular grommet or/and that of the outer tubular portion thereof at the inward open portion of the string hole or projecting the inward-side tip of the inner tubular portion or/and that of the outer tubular portion into the ball-hitting face beyond the inward open portion, it is possible to prevent the string tensionally mounted in the string hole from directly contacting the peripheral edge of the inward open portion of the string hole formed through the frame and thus enhancing the wear resistance of the string.

By disposing the inward-side tip of the inner tubular portion at the inward open portion of the string hole or into the ball-hitting face beyond the inner tubular portion, the area of contact between the string and the inner tubular portion is increased. This construction is capable of effectively damping the vibration of the string.

By disposing the inward-side tip of the outer tubular portion at the inward open portion of the string hole into the ball-hitting face or beyond the inner tubular portion, the area of contact between the string and the outer tubular portion is increased. This construction is capable of effectively damping the vibration of the frame.

Therefore it is preferable that the inward-side tip of each of the inner and outer tubular portions of the double-tubular grommet is disposed at the inward open portion of the string hole or projected into the ball-hitting face beyond the inward open portion.

More specifically, the length of the outer tubular portion should be determined in the relation with the length of the string hole. In consideration of the length of the string hole, the length of the outer tubular portion is set to not less than 5 mm, favorably not less than 8 mm, more favorably not less than 10 mm, and most favorably not less than 13 mm. When the length of the outward tubular portion is too long, the racket frame costs high and weighty. Therefore the length of the outer tubular portion is set to favorably not more than 30 mm, more favorably not more than 20 mm, and most favorably not more than 18 mm.

The longer the length of the inner tubular portion is, the larger the area of contact between the string and inner tubular portion is. Thereby the grommet member enhances the vibration-damping performance. Thus the length of the inner tubular portion is set to not less than 5 mm, favorably not less than 8 mm, more favorably not less than 10 mm, and most favorably not less than 13 mm. When the length of the inner tubular portion is too long, the vibration-damping effect little changes, and the double-tubular grommet is assembled at a low operability, which leads to an increase in the production cost of the racket frame. Therefore the length of the inner tubular portion is set to favorably not more than 30 mm, more favorably not more than 20 mm, and most favorably not more than 18 mm.

The lower limit in the thickness of the inner tubular portion is set to favorably not less than 0.2 mm, more favorably not less than 0.3 mm, and most favorably not less than 0.4 mm. The upper limit in the thickness of the inner tubular portion is set to not more than 2 mm, favorably not more than 1.5 mm, more favorably not more than 1.0 mm, and most favorably not more than 0.7 mm. If the lower limit in the thickness of the inner tubular portion is less than 0.2 mm, the double-tubular grommet member has a low vibration-damping effect. On the other hand, if the thickness of the inner tubular portion is more than 2 mm, the effect of damping the vibration of the string is low and thus the motion of the string can be restrained to a high extent.

The lower limit in the thickness of the outer tubular portion is set to favorably not less than 0.2 mm, more favorably not less than 0.3 mm, and most favorably not less than 0.4 mm. The upper limit in the thickness of the outer tubular portion is set to not more than 2 mm, favorably not more than 1.5 mm, more favorably not more than 1.0 mm, and most favorably not more than 0.7 mm. When the thickness of the outer tubular portion is less than 0.2 mm, the effect of damping the vibration of the frame deteriorates. On the other hand, if the thickness of the outer tubular portion is more than 2 mm, the racket frame costs high and is weighty, and in addition, the double-tubular grommet is mounted in the string hole formed through the racket frame at a low operability.

The string insertion hole of the inner tubular portion having the hollow portion is circular in its sectional configuration. In consideration of the diameter of the string, the diameter of the string insertion hole is set to not less than 1.3 mm nor more than 2.5 mm and favorably not less than 1.5 mm nor more than 2.0 mm. Thereby it is possible to restrain the stretched string from substantially changing in its position with respect to the string insertion hole when the ball is hit and thus prevent the stretched string from wearing because it little slidingly contacts the string insertion hole. Thus it is possible to stabilize the player's feeling for the ball when the player hits the ball.

The sectional configuration of the string insertion hole of the double-tubular grommet may be elliptic or oblong. In this case, the ratio of the maximum diameter to the minimum diameter in the sectional configuration of the string insertion hole is set to not more than 1.5, favorably not more than 1.2, and more favorably not more than 1.1. The value of (maximum diameter+minimum diameter)/2 is set to not less than 1.3 mm nor more than 2.5 mm and favorably not less than 1.5 mm nor more than 2.0 mm. When the string insertion hole is formed as a quadrilateral having bent portions in its sectional configuration, a pressure of contact between the string and the string insertion hole is different in dependence on a position of the string hole and thus a stress concentrates on a portion thereof. Thereby the string hole is liable to wear early. Therefore it is preferable that the periphery of the string insertion hole is constructed of a smoothly continuous curve.

The sectional configuration of the periphery of the outer tubular portion is so set that the periphery thereof is fitted in the string hole with the periphery thereof in close contact with the string hole. Thus the periphery thereof is composed of favorably a smoothly continuous curve and the outer tubular portion is especially favorably circular. When the string insertion hole is formed as a quadrilateral having bent portions, the double grommet is mounted in the string hole formed through the frame at a low operability.

The upper limit in the outer diameter of the outer tubular portion is set to favorably not more than 20 mm, more favorably not more than 15 mm, and most favorably not more than 12 mm. The lower limit in the outer diameter of the outer tubular portion is set to favorably not less than 5 mm and more favorably not less than 7 mm. When the outer diameter of the outer tubular portion is more than 20 mm, it is necessary to form the string hole having a large diameter through the frame, which deteriorates the strength of the frame. When the outer diameter of the outer tubular portion is less than 5 mm, the outer tubular portion and the inner tubular portion are liable to contact each other, when the string-tensioning force is set low and when the elasticity of the string deteriorates owing to use. Thereby the speed of the hit ball, the directionality of the hit ball, and the player's feeling for the ball when the player hits it are unstable.

The sectional configuration of the peripheral surface of the outward tubular portion may be elliptic or oblong. In this case, the ratio of the maximum diameter to the minimum diameter in the sectional configuration of the outward tubular portion is set to not more than 1.5, favorably not more than 1.2, and more favorably not more than 1.1. The upper limit of the value of (maximum diameter+minimum diameter)/2 is set to not more than 20 mm, favorably not more than 15 mm, and more favorably not more than 12 mm. The lower limit of the value of (maximum diameter+minimum diameter)/2 is set to not less than 5 mm and favorably not less than 7 mm.

The lower limit of the interval between the outer tubular portion and the inner tubular portion throughout the entire circumference of each of the outer tubular portion and the inner tubular portion is set to not favorably less than 1.5 mm, more favorably not less than 2 mm, and most favorably not less than 2.5 mm. The upper limit of the interval therebetween is set to favorably not more than 5 mm, more favorably not more than 4 mm, and most favorably not more than 3.5 mm. When the lower limit of the interval therebetween is less than 1.5 mm, the outer tubular portion and the inner tubular portion are liable to contact each other when the string-tensioning force is set low or the elasticity of the string deteriorates owing to use. Thereby the speed of the hit ball, the directionality of the hit ball, and the player's feeling for the ball when the player hits it are unstable. If the upper limit of the interval therebetween is more than 5 mm, the string holes formed through the frame have a large diameter respectively, thus deteriorating the durability thereof. In addition the outer tubular portion and the inner tubular portion are thin, thus deteriorating the vibration-damping performance.

It is preferable that the inward-side tip of the inner tubular portion is projected beyond the inward-side tip of the outer tubular portion and projected beyond the inward open portion of the string hole.

The ratio between an inner diameter D3 of the inner tubular portion and an inner diameter D6 of the outer tubular portion is set to D3:D6=1:2 to 1:10 and favorably 1:3 to 1:7.

It is favorable that an angle not more than 10 degrees is formed between the extension direction of the inner tubular portion of the double-tubular grommet before the string is tensionally inserted through the inner tubular portion and the extension direction of the string inserted through the inner tubular portion in the ball-hitting face.

Thereby the extension direction of the inner tubular portion is almost parallel with that of the string, and the variable support of the string can be securely shifted from the inner peripheral side of the frame to the peripheral side thereof. Therefore it is possible to effectively increase the sweet area. The above-described angle is set to more favorably not more than five degrees and most favorably not more than three degrees.

Preferably, supposing that a straight line formed by connecting an origin disposed at a center of an area of the ball-hitting face and a top of the racket frame to each other is set as a reference line and that straight lines formed by connecting the origin and a center of an area of an outward open portion of each of the string holes to each other is set as a string hole reference line, the double-tubular grommet is mounted in the string holes at which the string hole reference line is disposed in a region forming 10 to 80 degrees, 100 to 170 degrees, 190 to 260 degrees, 280 to 350 degrees to the reference line.

The above-described regions correspond to the four corners of the ball-hitting face. Because the variable length of the string is short at the four corners, the racket frame has a low repulsion, which is one of important factors of decreasing the sweet area. By disposing the double-tubular grommet at the four corners, it is possible to increase the variable length of the string and effectively enlarge the sweet area and improve the repulsion of the racket frame for the ball.

Of the above-described regions at the four corners, the region near the top at the top-side two corners and the region near the grip at the grip-side two corners are required to increase the sweet area and improve the repulsion for the ball. The top-side region is required to increase the sweet area and improve the repulsion for the ball to a higher extent than the bottom-side region. Therefore the double-tubular grommet is mounted in the string holes at which the string hole reference line is disposed in a region forming 10 to 45 degrees, 135 to 170 degrees, 190 to 225 degrees, 315 to 350 degrees to the reference line; favorably 10 to 45 degrees, 315 to 350 degrees; and more favorably 20 to 30 degrees, 330 to 340 degrees.

The number of the string holes where the double-tubular grommet is mounted is not less than one, favorably not less than two, and especially favorably not less than four in the above-described region. It is preferable to dispose the double-tubular grommets symmetrically with respect to the reference line formed by connecting the origin of the center of the area of the ball-hitting face and the top of the frame to each other.

It is possible to mount the double-tubular grommets in all of the string holes formed through the frame. But when a large number of the double-tubular grommets is mounted in the string holes, a large number of the string holes having a large diameter is mounted through the frame. In this case, the frame has a low strength and the productivity is low and the production cost is high. Therefore the number of the string holes in which the double-tubular grommets are mounted is set to not more than 20, favorably not more than 10, and more favorably not more than six.

For the same reason, the ratio of the number of string holes in which the double-tubular grommets are mounted respectively to the total number of string holes is set to not less than 1%, favorably not less than 3%, and more favorably not less than 5% and not more than 30%, favorably not more than 15%, and more favorably not more than 10%.

The lower limit total number of the string holes formed through the frame is set to favorably not less than 50, more favorably not less than 60, and most favorably not less than 70. The upper limit total number of the string holes formed through the frame is set to favorably not more than 100, more favorably not more than 90, and most favorably not more than 80. If the total number of the string holes is less than 50, the number of the strings is small. Thereby the racket frame has a low repulsion and ball control performance. On the other hand, if the total number of the string holes is more than 100, the string holes have a large diameter respectively. Thereby the frame has a low strength and the string-tensioning cost is high.

The ratio between an inner diameter D1 of the string hole in which the outer tubular portion of the double-tubular grommet is fitted and an inner diameter D2 of the string hole in which a grommet having only one tubular portion is fitted is set to D1:D2=3:2 to 5:1 and favorably 2:1 to 4:1.

The frame may be made of metal, wood, fiber reinforced resin, and the like. The fiber reinforced resin is preferable because it is excellent in its property and performance. For example, fiber reinforced resin is lightweight, has a high strength, and an excellent ball-hitting performance, and so on.

When the frame is made of the fiber reinforced resin, the average content ratio of the volume of fiber in the entire frame is set to favorably not less than 55%, more favorably not less than 58%, and most favorably not less than 60%. Generally when the average content ratio of the volume of fiber in the frame is increased, the frame has a merit that the rigidity thereof is improved, whereas the frame has a demerit that the vibration-damping performance thereof decreases. But the double-tubular grommet allows the racket frame of the present invention to have an excellent vibration-damping performance. Therefore even though the frame has a high average content ratio in the volume of fiber, the frame is capable of securing a necessary vibration-damping performance and can be provided with a merit that the rigidity thereof is improved.

The double-tubular grommet is formed by integrally molding resin or rubber having vibration-damping performance.

The tan δ of a material of the double-tubular grommet at −5° C. is set to not less than 0.03, favorably not less than 0.05, more favorably not less than 0.06, and most favorably not less than 0.10. The tan δ of the material of the double-tubular grommet at −5° C. is set not more than 0.5, favorably not more than 0.4, and especially favorably not more than 0.3. When the tan δ of the material of the double-tubular grommet at −5° C. is less than 0.3, the double-tubular grommet is incapable of obtaining a sufficient vibration-damping effect. On the other hand, when the tan δ of the material of the double-tubular grommet at −5° C. is more than 0.5, the double-tubular grommet has a low strength and in addition the controllability of the ball and the speed of the hit ball are liable to deteriorate.

The above-described tan δ is measured by a viscoelasticity measuring apparatus (viscoelasticity spectrometer of "DVA 200 improved type" produced by Shimadzu Corporation). As the measuring conditions, specimen: width of 4 mm×length of 30 mm×thickness of 1.66 mm, the length of a deformed portion of the specimen: 20 mm (both ends having a length of 5 mm of the entire length of 30 mm was held, initial strain: 2 mm (amplitude)±12.5 μm, frequency: 10 Hz; temperature rise speed: 2° C./minute, and temperature dispersion method was adopted.

It is possible to use crosslinked rubber, resin (including elastomer consisting of soft segment and hard segment), and the like as the material for the double-tubular grommet. For example, it is possible to use materials listed below singly or in combination:

(a) Thermoplastic polyurethane (b) Styrene elastomer (c) Nylon 6, containing or not containing rubber molecular chain, which is obtained by polymerization reaction (d) Rubber containing natural rubber, butyl rubber, acrylonitrile butadiene or the like as its base component For example, 5 to 80 parts of a polystyrene-vinyl polyisoprene block copolymer is added to 100 parts of a rubber material. "Haibura" produced by Kuraray Co., Ltd. is commercially available as the polystyrene-vinyl polyisoprene block copolymer. In addition to the polystyrene-vinyl polyisoprene block copolymer, various thermoplastic resins are commercially available. For example, "Sumi-light Resin PR-12686" can be used. As another additive, it is possible to add a rubber-like oil-extended polymer to the rubber material. To obtain the rubber-like oil-extended polymer, norbornene is synthesized from ethylene and cyclopentadiene. Ring opening polymerization of the norbornene is performed to obtain a polymer structure having six-membered rings and double bonds in its main chain. A large amount of extended oil is added to the polymer structure.

(e) Styrene thermoplastic elastomer ("Epo-friend" produced by Daicel Chemical Industries, Ltd.) in which the hard segment consists of polystyrene and the soft segment consists of an epoxidized unsaturated bonded portion contained in a diene component (f) Polybutylene terephthalate-polyether glycol ("Hai-toreru" produced by Du-Pont Inc.)

(g) Cashew-modified phenol resin ("Sumi-light Resin PR-12687" produced by Sumitomo?)

(h) A polymer alloy material ("Ella stage" produced by Tosoh Corporation), having various functions, which is composed of a plurality of polymers such as ester polymer, halogen-containing polymer, and the like (i) Material consisting of thermoplastic resin, rubber or a material containing modified thermoplastic resin or modified rubber.

For example, a material composed of a high polymer serving as a main component such as polyvinyl chloride, polyethylene, polypropylene, ethylene vinyl chloride polymer, methyl polymethacrylate, polyvinylidene fluoride, polyisoprene, polystyrene, styrene-butadiene-acrylonitrile copolymer, styrene-acrylonitrile copolymer, NBR, SBR, butadiene rubber, natural rubber, isoprene rubber, and mixtures of these high polymers; a substance such as mica, glass powder, glass fiber, carbon fiber, calcium carbonate, pearlite, and precipitated barium sulfate; and an additive such as corrosion inhibitor, dye, antioxidant, stabilizer, wetting agent added to the main component as necessary. It is also possible to use nylon resin, polyether block amide copolymer, and "PEBAX" produced by ATOFINA Inc.

It is preferable to use a soft material for the double-tubular grommet to enhance the vibration-damping performance of the frame. But when a material having a large tan δ is used for the double-tubular grommet, the double-tubular grommet is liable to be damaged by the ground owing to rubbing of the double-tubular grommet against the ground during the use of the racket. To overcome this problem, it is preferable to use a bumper member having a width larger than the width (width in the thickness direction of the frame) of the base portion of the double-tubular grommet and having a concavity or a hollow portion into which the base portion is fitted.

It is preferable that the outermost portion of the base portion is coincident with or inward from the outermost portion of the bumper member. But this construction is unessential. It is possible that the outermost portion of the base portion is disposed outward from the outermost portion of the bumper member, provided that the base portion is partly fitted in the concavity or the hollow portion of the bumper member.

It is necessary for the material of the bumper member to have a higher Shore D hardness than the double-tubular grommet. As the material of the bumper member, it is possible to use nylon resin, urethane resin, and the like.

The effect of the present invention is described below. As described above, in the present invention, by disposing the double-tubular grommet in the string hole formed through the string-stretching part, it is possible to prevent the string inserted into the inward tubular portion of the double-tubular grommet from contacting the outward tubular portion and the frame at the inward open portion of the string hole and thus prevent the string from being restrained in its motion. Therefore it is possible to increase the movable length of the string and the sweet area. Further because the inward tubular portion is capable of damping the vibration of the string and the outward tubular portion is capable of damping the vibration of the frame, it is possible to effectively prevent unpleasant vibration generated when the ball is hit from being transmitted to the player and thus provide the player with a preferable feeling.

Further because the base portion and the double-tubular portion of the double-tubular grommet are formed by integral molding, it is possible to assemble the double-tubular grommet with a high operability and prevent the double-tubular grommet from being defectively mounted in the string hole.

BRIEF DESCRIPTION OF THE DRAWINGS

FIG. 1 shows a racket frame of a first embodiment of the present invention, in which

FIG. 4 shows a double-tubular grommet (integrally formed double-tubular grommet), in which

FIG. 5 shows a construction in which a bumper member and a grommet are mounted on the racket frame, in which

DETAILED DESCRIPTION OF THE PREFERRED EMBODIMENTS

Figure 1A:
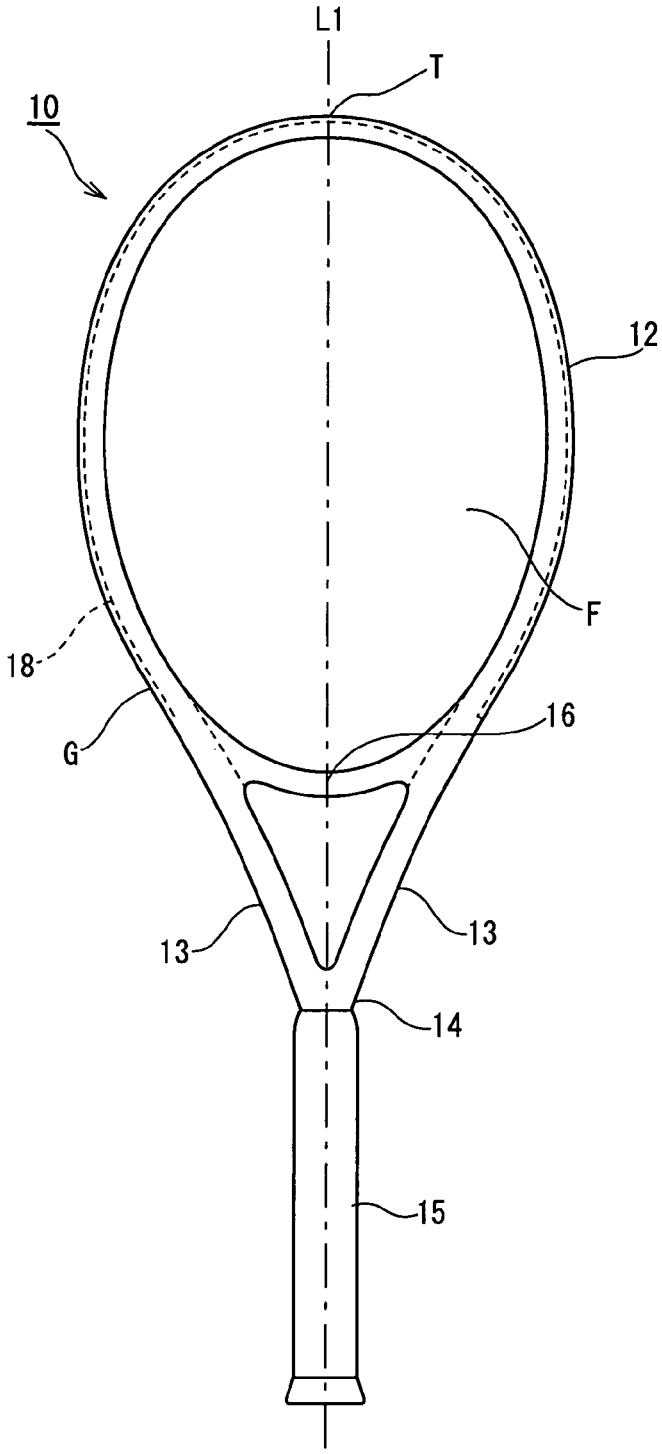
FIG. 1A is a front view and FIG. 1B is a side view.

The embodiments of the present invention will be described below with reference to the drawings.

Rackets of the embodiments which will be described below are regulation-ball tennis rackets.

FIGS. 1 through 6 show a racket frame 10 (hereinafter often referred to as merely frame 10) of the first embodiment of the present invention.

The racket frame 10 is composed of a hollow tubular body made of layered fiber reinforced resin sheets. The racket frame 10 has a head part 12, a throat part 13, a shaft part 14, and a grip part 15. These parts are continuously formed. The throat part 13 connecting the head part 12 and the shaft part 14 to each other is bifurcated. A yoke part 16 is formed between the left and right portions of the throat part 11. A string-stretching part G is constructed of the yoke part 16 and the head part 12. Longitudinal strings 51 and transverse strings 52 are tensionally inserted through 70 string holes 20 formed in penetration through the string-stretching part G to form a ball-hitting face F with the longitudinal strings 51 and the transverse strings 52.

Figure 1B:
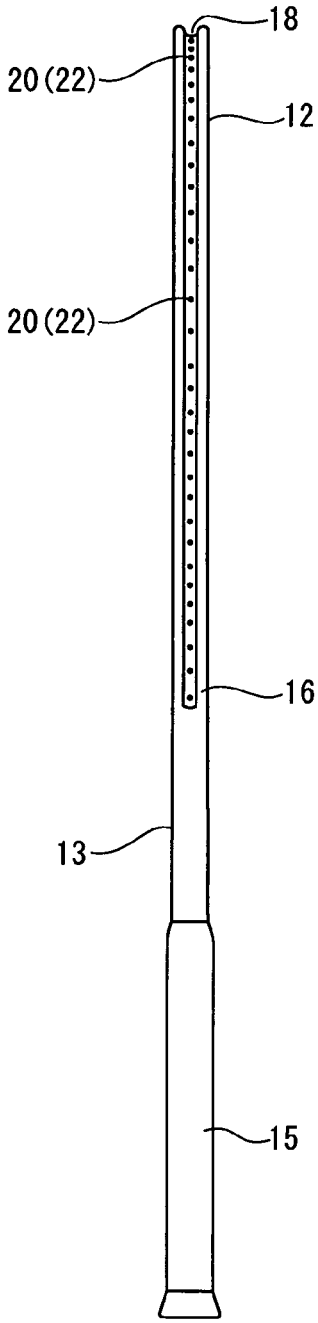

As shown in FIGS. 1A and 1B, a string groove 18 is circumferentially continuously formed on the head part 12 at the peripheral side thereof. 64 string holes 20 are formed in penetration through the head part 12 in the range from the bottom surface (peripheral side of racket frame) of the string groove 18 to the inner peripheral side of the heat part 12 which comes in contact with the periphery of the ball-hitting face F. Similarly six string holes 20 are formed in penetration through the yoke part 16.

Figure 2:
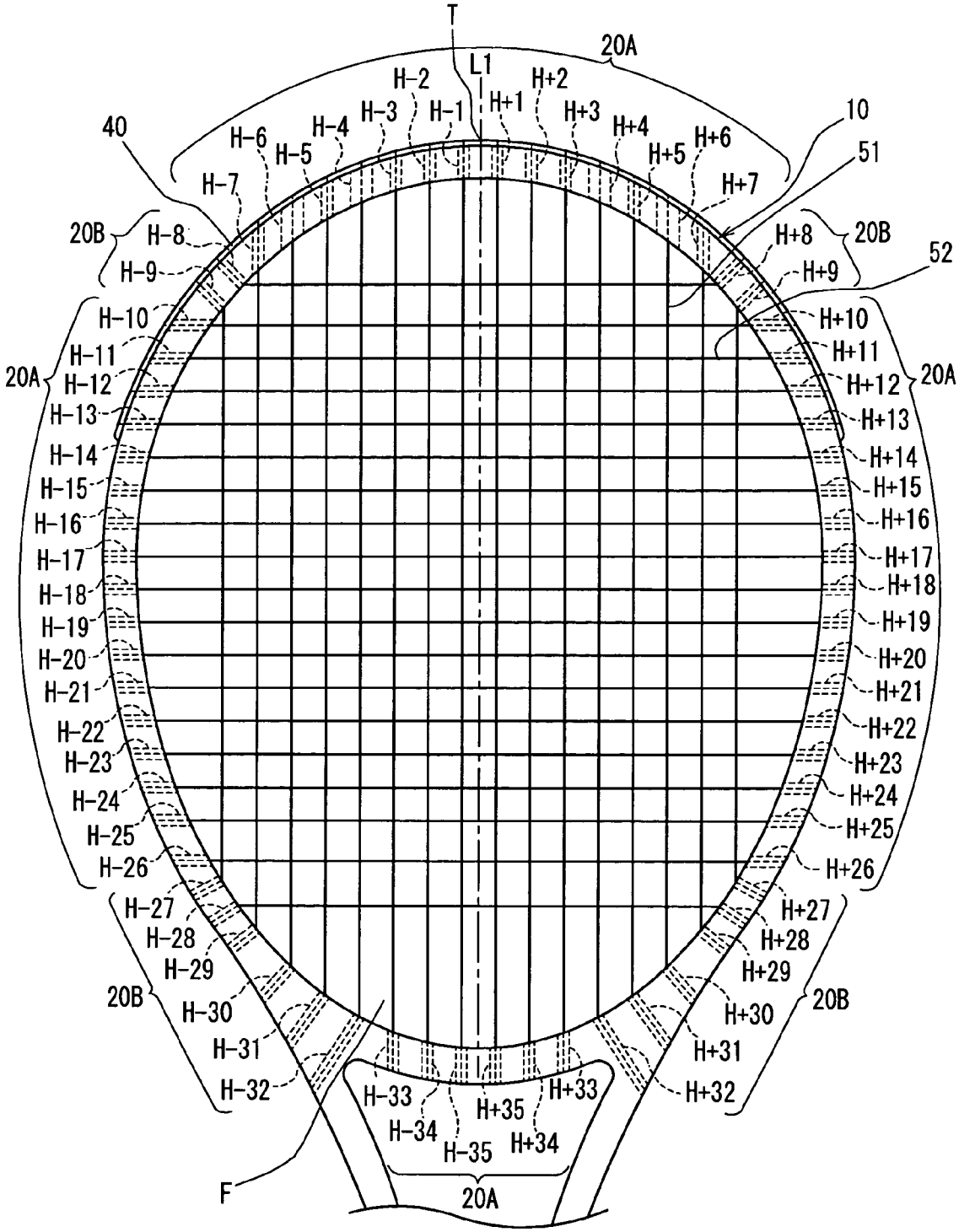
FIG. 2 is a main part-depicted front view showing a state in which strings are tensionally mounted through the racket frame shown in FIG. 1.

Of the 70 string holes 20, as shown in FIG. 2, 35 string holes 20 disposed at the right-hand side with respect to an axis L1 of the frame 10 formed by connecting a top T of the frame 10 and the axis of the grip part 15 are clockwise denoted as H+1, H+2, H+3, . . . , H+35 from the top T. Similarly 35 string holes 20 disposed at the left-hand side with respect to the axis L1 of the frame 10 are counterclockwise denoted as H−1, H−2, H−3, . . . , H−35 from the top T of the frame 1-.

An inward open portion 21 and an outward open portion 22 of each string hole 20 is sectionally circular. Of the 70 string holes 20, the string holes H−7 through H+7, H+10 through H+26, H−10 through H−26, H+33 through H+35, and H−33 through H−35 are parallel or orthogonal to the axis L1 of the frame 10. More specifically, the string holes 20 are formed as parallel string holes 20A penetrated through the head part 12 in parallel with the extension direction of the longitudinal strings 51 or the transverse strings 52 to be inserted therethrough respectively.

The string holes H±8, H±9, H+27 through H+32, and H−27 through H−32 are denoted as inclined string holes 20B penetrated through the head part 12 in almost orthogonally to the tangent to the frame 10.

Single-tubular grommets 30 or double-tubular grommets 33 are mounted in all of the 70 string holes 20. The longitudinal strings 51 and the transverse strings 52 are tensionally mounted on the string-stretching part G by penetrating the longitudinal strings 51 and the transverse strings 52 through the single-tubular grommets 30 and the double-tubular grommets 33.

Figure 3:
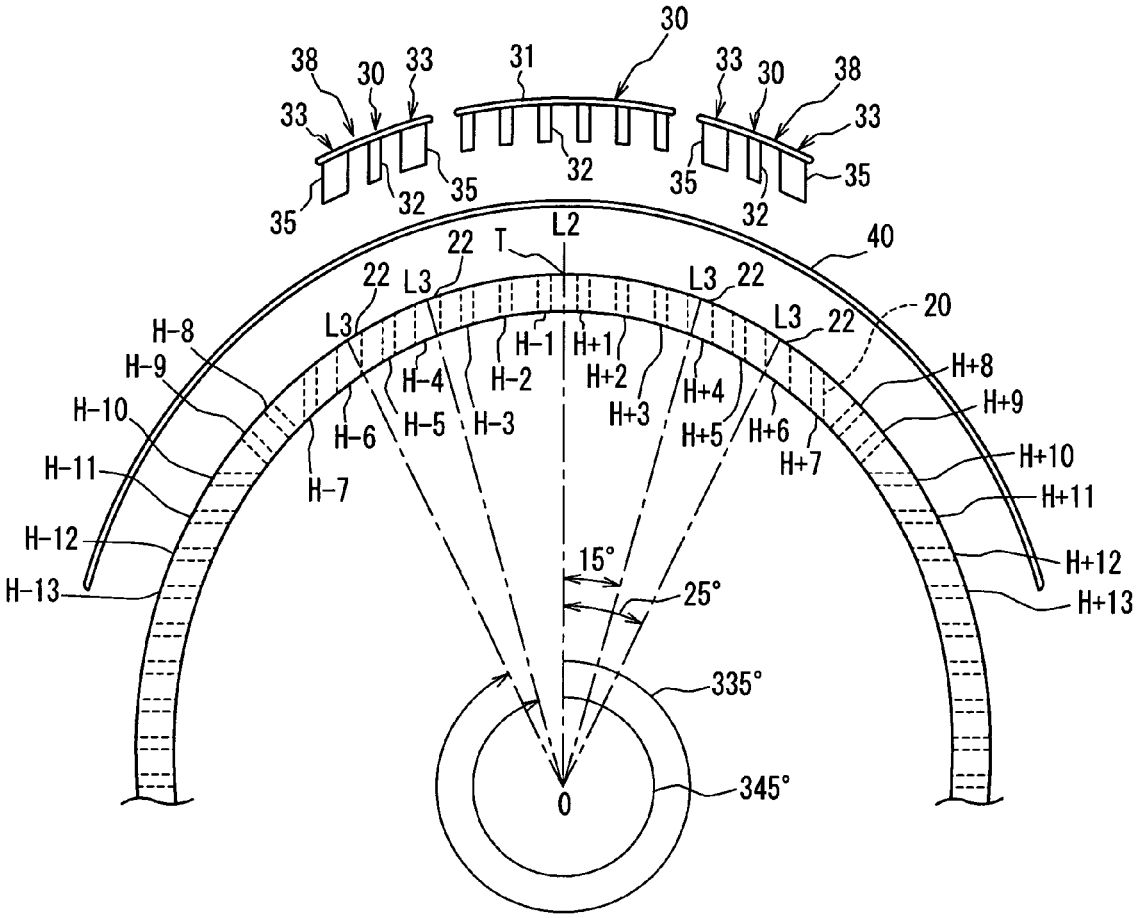
FIG. 3 is an exploded front view showing a top part of the racket frame shown in FIG. 2.
Figure 4A:
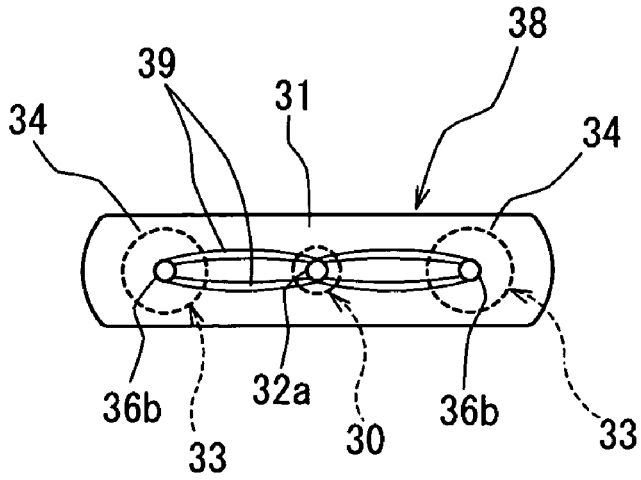
FIG. 4A is a plan view and FIG. 4B is a sectional view.
Figure 4B:
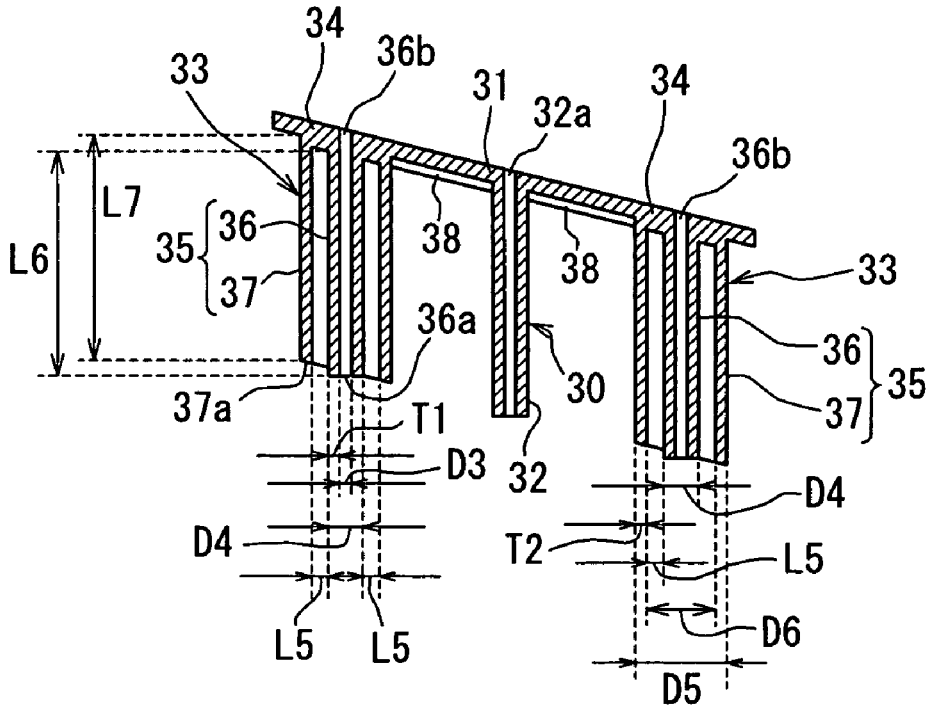
Figure 5A:
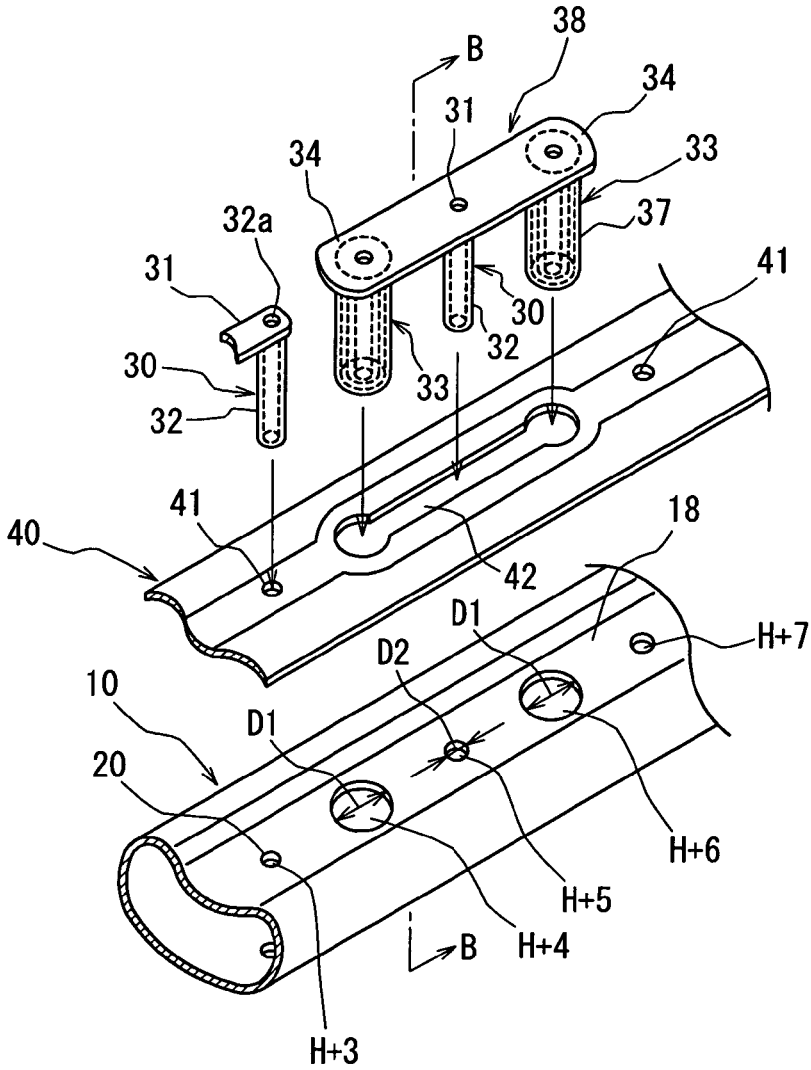
FIG. 5A is an exploded perspective view and FIG. 5B is a sectional view taken along a line B-B of FIG. 5A in a state in which the bumper member and the grommet have been mounted on the racket frame.

More specifically, as shown in FIG. 3, of all the parallel string holes 20A, the double-tubular grommets 33 are mounted in the four string holes H+4, H+6, H−4, and H−6. The string holes H+4, H+6, H−4, and H−6 are formed at positions where a reference line L3 of each of the four string holes H+4, H+6, H−4, and H−6 forms 15 degrees, 25 degrees, 345 degrees, and 335 degrees respectively to a reference line L2 formed by connecting the origin O of the center of the area of the ball-hitting face and the top T of the frame 10 to each other. As shown in FIG. 5A, a diameter D1 of each of the four string holes H+4, H+6, H−4, and H−6 is set to 10 mm which is larger than that of the other string holes 20.

Diameters D of the other parallel string holes 20A and the inclined string holes 20B are all set to 4 mm. As shown in FIG. 3, the single-tubular grommets 30 are mounted in the other parallel string holes 20A and the inclined string holes 20B respectively.

As shown in FIG. 3, a bumper member 40 is mounted on the peripheral surface of the top T of the frame 10 in the range from the string hole H−13 to the string hole H+13. As shown in FIG. 5, the single-tubular grommets 30 and the double-tubular grommets 33 are mounted in the string holes H−13 through H+13 with the bumper member 40 interposed between the frame 10 and the single-tubular grommets 30 and the double-tubular grommets 33.

As shown in FIG. 4, each double-tubular grommet 33 has a base portion 34 which contacts the peripheral surface of the frame 10 via the bumper member 40 and a double-tubular portion 35 projecting inward from the base portion 34. The double-tubular portion 35 has an inner tubular portion 36 and an outer tubular portion 37 disposed around the entire peripheral surface of the inner tubular portion 36 with the outer tubular portion 37 spaced at a certain interval from the inner tubular portion 36.

A string insertion hole 36*b* having an inner diameter D3 of 1.7 mm is formed in penetration through the inner tubular portion 36. The longitudinal string 51 is inserted through the string insertion hole 36*b* with the longitudinal string 51 in contact with the string insertion hole 36*b*. An outer diameter D4 of the inner tubular portion 36 is set to 3.0 mm. A thickness T1 of the inner tubular portion 36 is set to 0.65 mm.

Figure 6:
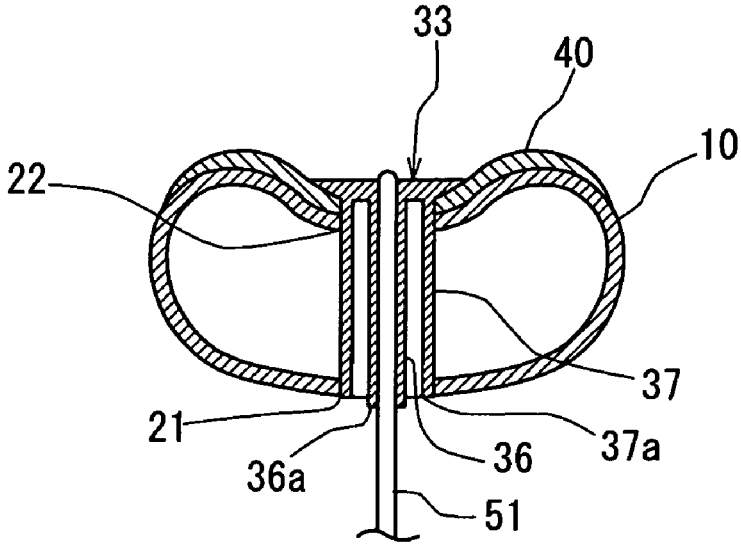
FIG. 6 is a sectional view showing a state in which the double-tubular grommet is mounted in a string hole.

An inner diameter D6 of the outer tubular portion 37 is set to 8.4 mm. An outer diameter D5 of the outer tubular portion 37 is set to 9.7 mm. As shown in FIG. 6, the longitudinal string 51 is mounted in the string insertion hole 36*b* with the longitudinal string 51 in contact with the inner peripheral surface of the inward open portion 21 and that of the outward open portion 22. A thickness T2 of the outer tubular portion 37 is set to 0.65 mm.

Thus an interval L5 between the entire peripheral surface of the inner tubular portion 36 and the entire inner peripheral surface of the outer tubular portion 37 is set to 2.7 mm.

A length L6 (see FIG. 4B) of the inner tubular portion 36 from the base portion 34 of the double-tubular grommet to an inward projected-side tip thereof is set to 13.1 mm. As shown in FIG. 6, the inward projected-side tip 36*a* of the inward tubular portion 36 is slightly projected inward beyond the inward open portion 21 of the string hole 20 formed through the frame 10.

A length L7 (see FIG. 4B) of the outer tubular portion 37 from the base portion 34 of the double-tubular grommet to an inward projected-side tip thereof is set to 13.1 mm. As shown in FIG. 6, the inward projected-side tip 37*a* of the outward tubular portion 37 contacts the inner peripheral surface of the inward open portion 21 of the string hole 20 formed through the frame 10.

As shown in FIG. 5A, each single-tubular grommet 30 has a base portion 31 to be disposed on the peripheral surface of the frame 10 and one tubular portion 32, having a string insertion hole 32*a*, which is projected inward from the base portion 31 disposed on the peripheral side of the frame 10.

As shown in FIGS. 4 and 5, the double-tubular grommets 33 to be mounted on the string holes H+4, H+6 are connected to the single-tubular grommet 30 to be mounted on the string hole H+5 disposed between the string holes H+4 and H+6 by means of the base portions 34, 31 to form an integrally formed double-tubular grommet 38, having the shape of a belt, which is constructed of the double-tubular grommets 33 and the single-tubular grommet 30 integrally connected with the double-tubular grommets 33.

A pair of guide ribs 39 for guiding the string is provided on the outer surface of the belt-shaped integrally formed double-tubular grommet 38 between the string insertion hole 36*b* (see FIG. 4A) of the double-tubular grommet and the string insertion hole 32*a* of the single-tubular grommet 30.

The integrally formed double-tubular grommet 38 is formed by integrally molding a polyether block amide copolymer having tan δ of 0.10 at −5° C. and Shore D hardness of 69.

The double-tubular grommets 33 to be mounted in the string holes H−4 and H−6 and the single-tubular grommet 30 to be mounted in the string hole H−5 are also formed as the integrally formed double-tubular grommet 38.

Other single-tubular grommets 30, made of Rirusan (nylon 11), having tan δ of 0.03 at −5° C. and Shore D hardness of 85 adjacent to each other are integrally molded by connecting the base portions 31 of the single-tubular grommets 30 to each other in the shape of a belt.

As shown in FIG. 5A, the bumper member 40 is belt-shaped and mounted on the frame 10 along the peripheral surface of the frame 10 and the string groove 18. The bumper member 40 is formed by molding the Rirusan having tan δ of 0.03 at −5° C. and Shore D hardness of 85. Formed through the bumper member 40 are a first grommet hole 41 through which the tubular portion 32 of the single-tubular grommet 30 is inserted and an elongated second grommet hole 42 through which the double-tubular portion 35 of the integrally formed double-tubular grommet 38 and the tubular portion 32 of the single-tubular grommet 30 thereof are inserted.

Figure 5B:
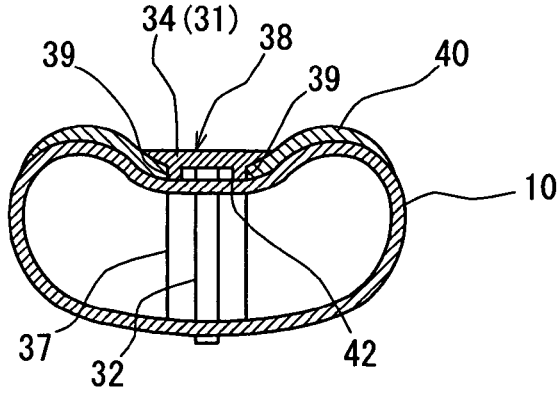

In mounting the integrally formed double-tubular grommet 38 in the second grommet hole 42, as shown in FIG. 5B, the guide ribs 39 inward projected at both sides of the base portions 34, 31 in the widthwise direction thereof are fixedly fitted in the second grommet hole 42.

As shown in FIG. 6, in the frame 10 having the above-described construction, the inner tubular portion 36 of the double-tubular grommet 33 contacts the string 51, whereas the outer tubular portion 37 contacts the frame 10. Therefore this construction is capable of damping the vibration of the string 51 and that of the frame 10 and thus effectively suppressing the generation of an unpleasant vibration and providing a player with a favorable feeling when the player hits the ball. Further the frame 10 is so constructed that the inward projected-side tip 36*a* of the inner tubular portion 36 and the inward projected-side tip 37*a* of the outer tubular portion 37 are disposed at or beyond the inward open portion 21 of the string hole 21 to increase the area of contact between the inner tubular portion 36 and the string 51 and between the outer tubular portion 37 and the frame 10. Thus the vibration-damping effect can be effectively displayed.

In the double-tubular grommet 33, because the inner tubular portion 36 of the string insertion hole 36*b* and the outer tubular portion 37 thereof are spaced at a certain interval throughout the entire circumference of the inward tubular portion 36 and the entire circumference of the outward tubular portion 37, it is possible to secure the movable range of the inner tubular portion 36 inside the outward tubular portion 37, namely, the movable range of the longitudinal string 51 throughout the entire circumference of the outward tubular portion 37. Therefore the racket frame 10 is capable of enhancing the repulsion of a hit ball by shifting the variable support of the longitudinal string 51 at the peripheral side of the frame 10.

The string holes H±4 and H±6 in which the double-tubular grommet 33 is mounted are formed as the parallel string holes 20A. Almost zero degree is formed between the extension direction of the inner tubular portion 36 of the double-tubular grommet 33 mounted in the parallel string hole 20A before the longitudinal string 51 is tensionally inserted through the inner tubular portion 36 and the extension direction of the longitudinal string 51 inserted through the inner tubular portion 36 in the ball-hitting face F. This construction prevents the motion of the longitudinal string 51 from being restrained because the longitudinal string 51 does not strike the inward open portion 21 of the string hole 20 and is capable of effectively increasing the variable length of the longitudinal string 51.

To increase the sweet area of the racket frame, of the regions at the four corners of the ball-hitting face F strongly demanded to have an improved repulsion for the ball, two double-tubular grommets 33 are disposed at each of the top-side two corners. Therefore it is possible to effectively increase the sweet area.

The inward projected-side tip 36*a* of the inner tubular portion 36 and the inward projected-side tip 37*a* of the outer tubular portion 37 are disposed at or beyond the inward open portion 21. This construction is capable of preventing the longitudinal string 51 tensionally mounted in the parallel string hole 20A from wearing because the longitudinal string 51 does not rub the peripheral edge of the inward open portion 21 of the string hole 20.

Because the base portion 34 of the double-tubular grommet 33 and the double-tubular portion 35 thereof are integrally formed, it is possible to assemble the double-tubular grommet 33 with a high operability, prevent the double-tubular grommet 33 from being defectively mounted in the string hole 20, and provide the double-tubular grommet 33 with a high wear resistance.

EXAMPLES

As shown in table 1, in prepared racket frames of an example 1 and comparison examples 1 through 3, different grommets were mounted in the string holes H+4, H+6, H−4, and H−6 formed at positions where the reference line L3 thereof formed 15 degrees, 25 degrees, 345 degrees, and 335 degrees respectively to the reference line L2 formed by connecting the origin O of the area of the ball-hitting face of the racket frame and the top T (see FIG. 2) of the racket frame to each other. To evaluate the sweet area of each racket frame and the vibration-damping performance thereof, a ball-hitting test was conducted. Table 1 shows results.

TABLE 1

| | | Example | Comparison example | Comparison example 2 | Comparison example 3 |
|---|---|---|---|---|---|
| Sweet area | Better (wider) | 13 Players | Reference racket frame | 16 Players | 15 Players |
| | Equal | 7 Players | Reference racket frame | 4 Players | 5 Players |
| | worse (smaller) | 0 Players | Reference racket frame | 0 Players | 0 Players |
| vibration-damping performance | Better (wider) | 9 Players | Reference racket frame | 0 Players | 0 Players |
| | Equal | 11 Players | Reference racket frame | 14 Players | 12 Players |
| | worse (smaller) | 0 Players | Reference racket frame | 6 Players | 8 Players |
| Addition of number of players in both evaluations | Better (wider) | 22 Players | Reference racket frame | 16 Players | 15 Players |
| | Equal | 18 Players | Reference racket frame | 18 Players | 17 Players |
| | worse (smaller) | 0 Players | Reference racket frame | 6 Players | 8 Players |

The racket frame of each of the example 1 and the comparison examples 1 through 3 were hollowly formed in the same configuration by molding fiber reinforced thermoplastic resin. All the racket frames had an area of 100 square inches in the ball-hitting face F thereof, the whole length of 27 inches in the longitudinal length thereof, and 70 string holes.

More specifically, prepreg sheets made of the fiber reinforced resin composed of carbon fibers serving as the reinforcing fiber thereof and epoxy resin serving as the matrix thereof were layered one upon another at angles of 0°, 22°, 30°, 45°, and 90° on a mandrel covered with an internal pressure tube made of nylon 66 to form a vertical laminate of the prepreg sheets. After the mandrel was pulled out of the laminate, the laminate was set in a die. The die was clamped and heated to 150° for 30 minutes, with an air pressure of 9 kgf/cm$^2$ kept applied to the inside of the internal pressure tube to form the racket frames.

The configurations of string holes 20 of the racket frames of the example 1 and the comparison examples 1 through 3 were set identically to that of the first embodiment. More specifically, 70 string holes 20 (H±1 through H±35) of each racket frame were sectionally circular. Of the 70 string holes 20, string holes H+1 through H+7, H−1 through H−7, H+10 through H+26, H−10 through H−26, H+33 through H+35, and H−33 through H−35 were formed as parallel string holes 20A, whereas H±8, H±9, H+27 through H+32, H−27 through H−32 were formed as inclined string holes.

In the racket frames of the example 1 and the comparison examples 1 through 3, various types of grommets were mounted in the string holes H−1 through H−13 and H+1 through H+13 of the above-described string holes 20 through the bumper member 40, similarly to the first embodiment.

A product "Article No.: BMP O P20" (tan δ: 0.03 at −5° C., Shore D hardness: 85, and material: Rirusan (nylon 11)) produced by Toray Industries Inc. was molded to form the bumper member 40.

The single-tubular grommet 30 was mounted in string holes other than the string holes H+4, H+6, H−4, and H−6. The product "Article No.: BMP O P20" (tan δ: 0.03 at −5° C., Shore D hardness: 85, and material: Rirusan (nylon 11)) produced by Toray Industries Inc. was molded to form the single-tubular grommet 30.

Example 1

The racket frame of the example 1 had the same construction as that of the racket frame of the first embodiment. More specifically, the double-tubular grommets 33 were mounted in the string holes H+4, H+6, H−4, and H−6. The inward projected-side tip 36*a* of the inner tubular portion 36 was slightly projected inward beyond the inward open portion 21 of the string hole 20. The inward projected-side tip 37*a* of the outer tubular portion 37 was brought into contact with the inner peripheral surface of the inward open portion 21 of the string hole 20.

The product "PEBAX7033" (tan δ at −5° C.: 0.10, Shore D hardness: 69, material: polyether block amide copolymer) produced by ATOFINA Inc. was molded to form the double-tubular grommet 33.

Comparison Example 1

The single-tubular grommet 30 was mounted in all of the 70 string holes 20.

Comparison Example 2

Figure 9:
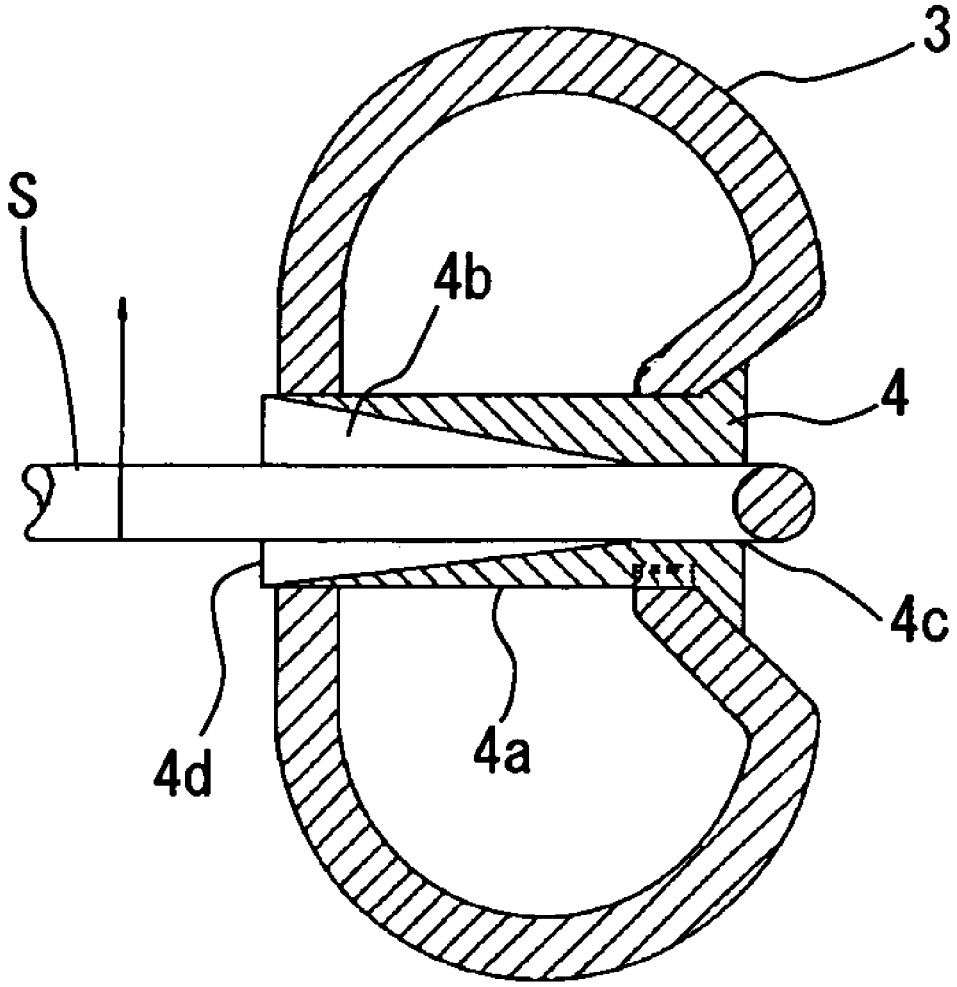
FIG. 9 shows another conventional art.
Figure 10A:
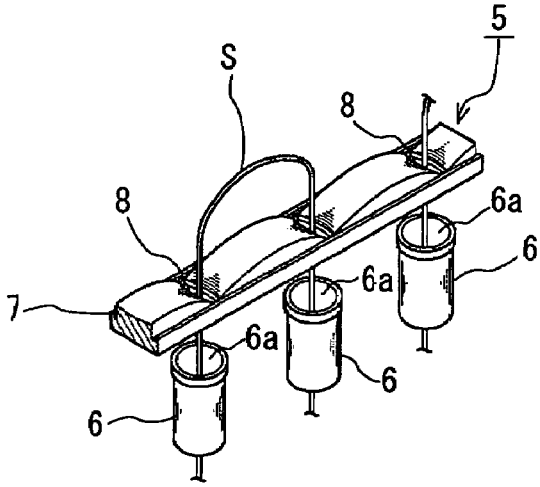
FIG. 10 shows still another conventional art.
Figure 10B:
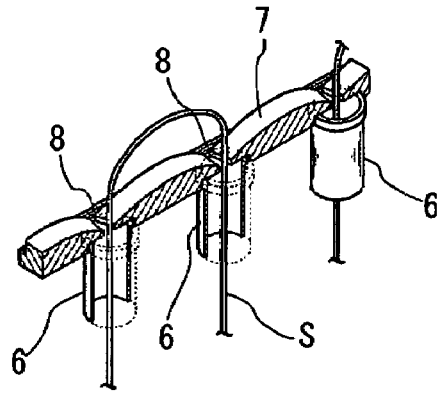
Prior Art Fig. 10B

A conventional grommet 4 shown in FIG. 9 was mounted in the string holes H+4, H+6, H−4, and H−6. The tubular portion 4*a* of the grommet 4 and the string insertion hole 4*b* were formed sectionally circularly.

Comparison Example 3

Figure 7:
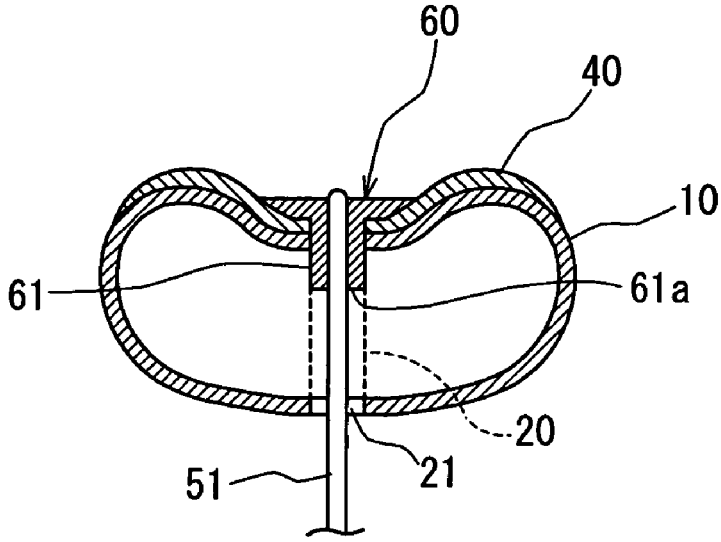
FIG. 7 is a main part-depicted sectional view showing a comparison example 3.
Figure 8:
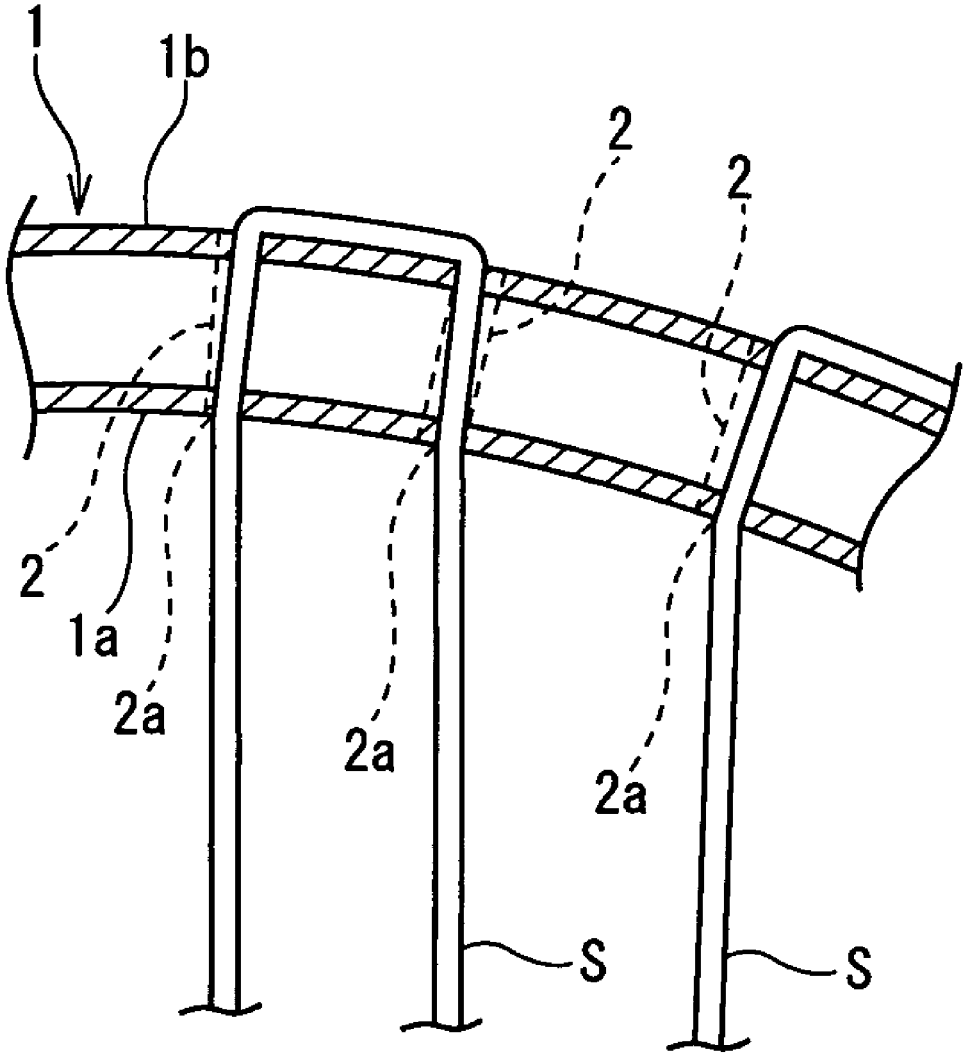
FIG. 8 shows the problem of a conventional art.

A grommet 60 shown in FIG. 7 was mounted in the string holes H+4, H+6, H−4, and H−6. A tubular portion 61 of the grommet 60 was short to such an extent that a tip 61*a* of the tubular portion 61 did not reach the inward open portion 21 of the string hole 20.

Ball-Hitting Test 20 tennis players were requested to hit balls with tennis rackets having string-stretched racket frames of the example 1 and the comparison examples 1 through 3 to make an organoleptic evaluation. More specifically, "better (wider) than the tennis racket frame of the comparison example 1", "equal to the tennis racket frame of the comparison example 1", and "worse (smaller) than the tennis racket frame of the comparison example 1". Table 1 shows the number of players who responded affirmatively for each item.

As shown in table 1, many players made evaluations that the racket frames of the example 1 and the comparison examples 2 and 3 had a wider sweet area than the racket frame of the comparison example 1, but did not evaluate that the vibration-damping performance of the racket frames of the comparison examples 2 and 3 was higher than that of the racket frame of the comparison example 1. Some players evaluated that the vibration-damping performance of the racket frames of the comparison examples 2 and 3 was inferior to that of the racket frame of the comparison example 1. On the other hand, many players made evaluations that the vibration-damping performance of the racket frame of the example 1 was higher than that of the racket frame of the comparison example 1. No players made evaluations that the vibration-damping performance of the racket frame of the example 1 was inferior to that of the racket frame of the comparison example 1.

The double-tubular grommet 33 was mounted on the racket frame of the example 1. Thus the movable length of the string of the racket frame of the example 1 was long, and a sufficient area of contact was obtained between the double-tubular grommet 33 and the string as well as the racket frame. Thereby it was possible to provide the racket frame of the example 1 with a large sweet area and a high degree of vibration-damping performance in a favorable balance. On the other hand, in the racket frames of the comparison examples 2 and 3, it was possible to increase the movable length of the string, but the area of contact between the double-tubular grommet and the string as well as the racket frame was small. Thereby the racket frames of the comparison examples 2 and 3 had a low degree of vibration-damping performance.

What is claimed is:

1. A racket comprising a string-stretching part for forming a ball-hitting face by tensionally mounting strings in string holes formed through said string-stretching part, in which grommets are mounted respectively, wherein as said grommets, a double-tubular grommet is mounted in at least one of said string holes, said double-tubular grommet is formed as an integrally molded article, comprising:

an inner tubular portion having a string insertion hole through which said string is inserted to be in contact with said string insertion hole and to be pulled from an inward-end open portion thereof or an outward-end open portion thereof;

an outer tubular portion fitted in said string hole formed through said string-stretching part with said outer tubular portion being spaced at a certain interval from said inner tubular portion; and a base portion integrally connected with an outward-side end of said inner tubular portion and that of said outer tubular portion and disposed on a peripheral surface of said string-stretching part.

2. The racket according to claim 1, wherein an inward-side tip of said inner tubular portion of said double-tubular grommet or/and an inward-side tip of said outer tubular portion thereof are disposed at an inward open portion of said string hole or projected into said ball-hitting face beyond said inward open portion; and an angle not more than 10 degrees is formed between an extension direction of said inner tubular portion before said string is tensionally mounted in said inner tubular portion and an extension direction of said string in said ball-hitting face when said string is tensionally mounted in said inner tubular portion.

3. The racket according to claim 2, wherein supposing that a straight line formed by connecting an origin disposed at a center of an area of said ball-hitting face and a top of said racket frame to each other is set as a reference line and that straight lines formed by connecting said origin and a center of an area of an outward open portion of each of said string holes to each other is set as a string hole reference line, said double-tubular grommet is mounted in said string holes at which said string hole reference line is disposed in a region forming 10 to 80 degrees, 100 to 170 degrees, 190 to 260 degrees, 280 to 350 degrees to said reference line.

4. The racket according to claims 2, wherein said inward-side tip of said inner tubular portion of said double-tubular grommet is projected beyond said inward-side tip of said outer tubular portion thereof; a ratio between an inner diameter D3 of said inner tubular portion and an inner diameter D6 of said outer tubular portion is set to D3:D6=1:2 to 1:10; and a gap between a peripheral surface of said inner tubular portion and an inner peripheral surface of said outer tubular portion is set to 1.5 mm to 5 mm; and a ratio between an inner diameter D1 of said string hole in which said double-tubular grommet is fitted and an inner diameter D2 of said string hole in which a grommet having only one tubular portion is fitted is set to D1:D2=3:2 to 5:1.

5. The racket according to claim 2, wherein said double-tubular grommet is formed by integrally molding rubber or resin having vibration-damping performance;

said base portion of said double-tubular grommet is integrally connected with a base portion of an adjacent double-tubular grommet or/and a base portion of an adjacent grommet having only one tubular portion so that an integrally formed double-tubular grommet is belt-shaped; and a pair of guide ribs is formed so as to project on an outer surface of said belt-shaped integrally formed double-tubular grommet with said guide ribs spanning between said string inserted through said string insertion hole of said inner tubular portion of said double-tubular grommet and/or said string inserted through said string insertion hole of said grommet having said one tubular portion.

6. The racket according to claim 1, wherein supposing that a straight line formed by connecting an origin disposed at a center of an area of said ball-hitting face and a top of said racket frame to each other is set as a reference line and that straight lines formed by connecting said origin and a center of an area of an outward open portion of each of said string holes to each other is set as a string hole reference line, said double-tubular grommet is mounted in said string holes at which said string hole reference line is disposed in a region forming 10 to 80 degrees, 100 to 170 degrees, 190 to 260 degrees, 280 to 350 degrees to said reference line.

7. The racket according to claim 6, wherein said inward-side tip of said inner tubular portion of said double-tubular grommet is projected beyond said inward-side tip of said outer tubular portion thereof; a ratio between an inner diameter D3 of said inner tubular portion and an inner diameter D6 of said outer tubular portion is set to D3:D6=1:2 to 1:10; and a gap between a peripheral surface of said inner tubular portion and an inner peripheral surface of said outer tubular portion is set to 1.5 mm to 5 mm; and a ratio between an inner diameter D1 of said string hole in which said double-tubular grommet is fitted and an inner diameter D2 of said string hole in which a grommet having only one tubular portion is fitted is set to D1:D2=3:2 to 5:1.

8. The racket according to claim 6, wherein said double-tubular grommet is formed by integrally molding rubber or resin having vibration-damping performance;

said base portion of said double-tubular grommet is integrally connected with a base portion of an adjacent double-tubular grommet or/and a base portion of an adjacent grommet having only one tubular portion so that an integrally formed double-tubular grommet is belt-shaped; and a pair of guide ribs is formed so as to project on an outer surface of said belt-shaped integrally formed double-tubular grommet with said guide ribs spanning between said string inserted through said string insertion hole of said inner tubular portion of said double-tubular grommet and/or said string inserted through said string insertion hole of said grommet having said one tubular portion.

9. The racket according to claim 1, wherein said inward-side tip of said inner tubular portion of said double-tubular grommet is projected beyond said inward-side tip of said outer tubular portion thereof; a ratio between an inner diameter D3 of said inner tubular portion and an inner diameter D6 of said outer tubular portion is set to D3:D6=1:2 to 1:10; and a gap between a peripheral surface of said inner tubular portion and an inner peripheral surface of said outer tubular portion is set to 1.5 mm to 5 mm; and a ratio between an inner diameter D1 of said string hole in which said double-tubular grommet is fitted and an inner diameter D2 of said string hole in which a grommet having only one tubular portion is fitted is set to D1:D2=3:2 to 5:1.

10. The racket according to claim 1, wherein said double-tubular grommet is formed by integrally molding rubber or resin having vibration-damping performance;

said base portion of said double-tubular grommet is integrally connected with a base portion of an adjacent double-tubular grommet or/and a base portion of an adjacent grommet having only one tubular portion so that an integrally formed double-tubular grommet is belt-shaped; and a pair of guide ribs is formed so as to project on an outer surface of said belt-shaped integrally formed double-tubular grommet with said guide ribs spanning between said string inserted through said string insertion hole of said inner tubular portion of said double-tubular grommet and/or said string inserted through said string insertion hole of said grommet having said one tubular portion.

11. The racket according to claim 1, wherein a ratio between an inner diameter D3 of said inner tubular portion and an inner diameter D6 of said outer tubular portion is set to D3:D6=1:2 to 1:10.

12. The racket according to claim 1, wherein a gap between a peripheral surface of said inner tubular portion and an inner peripheral surface of said outer tubular portion is set to 1.5 mm to 5 mm.

13. The racket according to claim 1, wherein an inward side tip of the inner tubular portion is disposed at an inward open portion of the string hole or projected into the ball-hitting face beyond the inward open portion.

14. The racket according to claim 1, wherein the double-tubular grommet is formed by integrally molding resin or rubber and the tan δ of the material of the double-tubular grommet at −5° C. is set to 0.03 to 0.5.

* * * * *